US005291976A

United States Patent [19]

Ku

[11] Patent Number: 5,291,976

[45] Date of Patent: Mar. 8, 1994

[54] WHEELED SUITCASE OF LUGGAGE SUPPORT WITH COLLAPSIBLE TOWING HANDLE

[75] Inventor: Don Ku, Flushing, N.Y.

[73] Assignee: Liberty Leather Products Co. Inc., Brooklyn, N.Y.

[21] Appl. No.: 26,524

[22] Filed: Mar. 4, 1993

[51] Int. Cl.[5] ..... A45C 5/14

[52] U.S. Cl. ..... 190/18 A; 190/39; 190/117; 16/115; 280/47.26; 403/368; 403/374; 403/396

[58] Field of Search ..... 190/18 A, 39, 115, 117; 280/37, 47.26; 403/367, 368, 373, 374, 396; 16/115

[56] References Cited

U.S. PATENT DOCUMENTS

| | | | |
|---|---|---|---|
| 2,581,417 | 1/1952 | Jones | 280/38 |
| 2,757,935 | 8/1956 | Sofia | 280/47.26 X |
| 3,199,643 | 8/1965 | Korchmar | 190/51 |
| 3,257,120 | 6/1966 | Browning | 280/47.17 |
| 3,306,404 | 2/1967 | Yellin | 190/51 |
| 3,606,372 | 9/1971 | Browning | 280/47.17 |
| 3,917,038 | 11/1975 | Fage et al. | 190/18 A |
| 4,036,336 | 7/1977 | Bartley | 190/18 A |
| 4,087,102 | 5/1978 | Sprague | 280/37 |
| 4,254,850 | 3/1981 | Knowles | 190/18 A |
| 4,256,320 | 3/1981 | Hager | 280/37 |
| 4,261,447 | 4/1981 | Arias et al. | 190/18 A |
| 4,284,287 | 8/1981 | Esposito | 16/115 X |
| 4,354,689 | 10/1982 | Perego | 16/115 X |
| 4,411,343 | 10/1983 | Cassimally | 190/18 A |
| 4,523,773 | 6/1985 | Holtz | 16/115 X |
| 4,616,379 | 10/1986 | Lio | 16/115 |
| 4,618,035 | 10/1986 | Mao | 190/18 A |
| 4,759,431 | 7/1988 | King et al. | 190/18 A |
| 4,792,025 | 12/1988 | Thomas | 190/18 A |
| 4,995,487 | 2/1991 | Plath | 190/18 A |
| 5,108,119 | 4/1992 | Huang | 280/37 |
| 5,114,164 | 5/1992 | Bothwell et al. | 280/37 |
| 5,116,289 | 5/1992 | Pond et al. | 190/18 A |
| 5,167,306 | 12/1992 | Carrigan, Jr. | 190/18 A |
| 5,181,590 | 1/1993 | Carpenter et al. | 190/18 A |
| 5,197,579 | 3/1993 | Bieber et al. | 190/18 A |

FOREIGN PATENT DOCUMENTS

| | | | |
|---|---|---|---|
| 3328063 | 2/1985 | Fed. Rep. of Germany . | |
| 2409720 | 11/1979 | France . | |
| 2538229 | 6/1984 | France . | |
| 1539021 | 1/1979 | United Kingdom . | |
| 2168035 | 6/1986 | United Kingdom . | |
| 2224770 | 5/1990 | United Kingdom | 190/39 |

*Primary Examiner*—Allan N. Shoap
*Assistant Examiner*—Christopher McDonald
*Attorney, Agent, or Firm*—Ostrolenk, Faber, Gerb & Soffen

[57] ABSTRACT

A suitcase including a luggage member, a support structure attached to the luggage member, the support structure having a first horizontal member having two wheels thereon to facilitate towing on the ground, a second horizontal member, two tubular members coupling the first and second horizontal members, thereby forming a rectangular frame, a shaft in extensible slidable engagement in each of the tubular members, the shafts being connected by a first handle, the shafts being extensible between a collapsed position in the tubular members and a fully extended position to enable towing of the luggage member on the wheels, at least one of the shafts including a wedging member slidable within the respective tubular member which is received frictionally in a first bore provided at an end of the respective tubular member adjacent the second horizontal member to maintain the shafts in the fully extended position.

28 Claims, 3 Drawing Sheets

FIG. 5
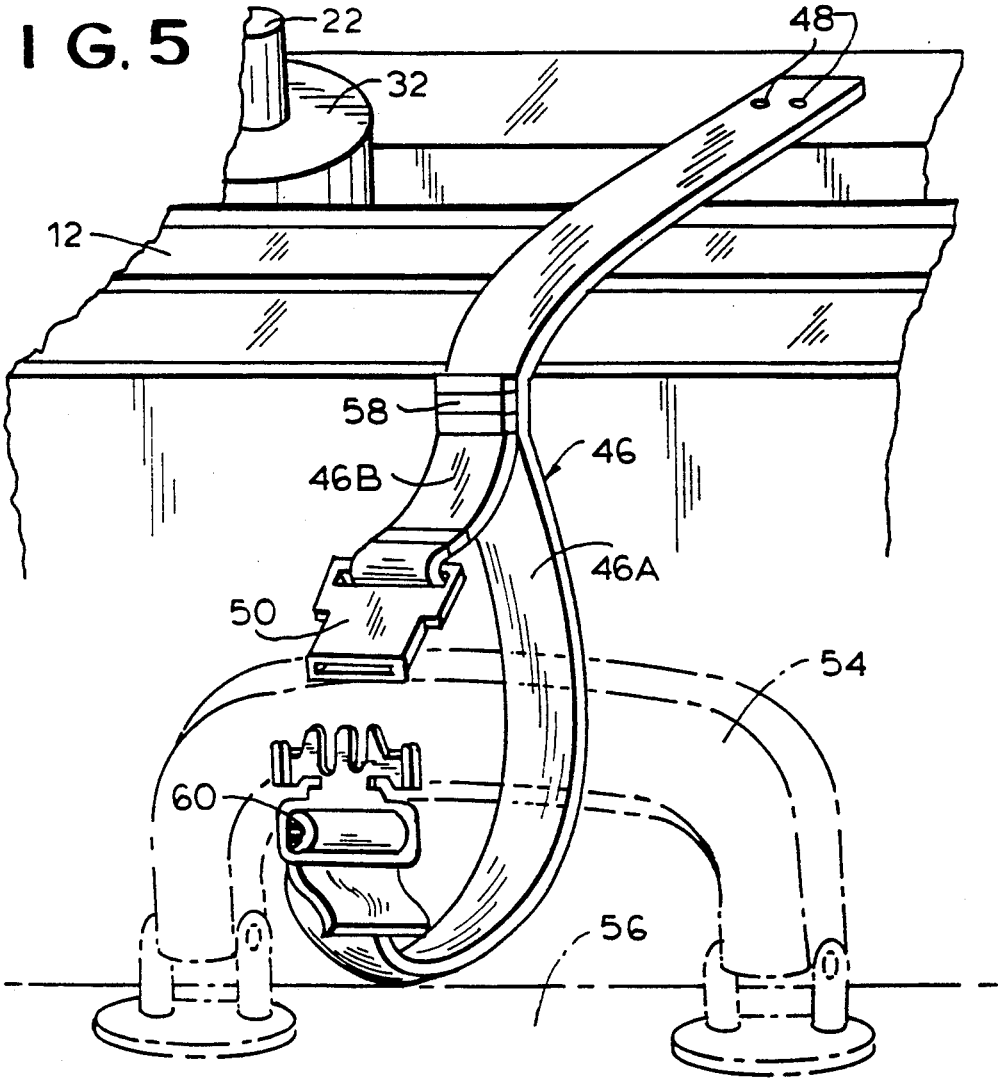
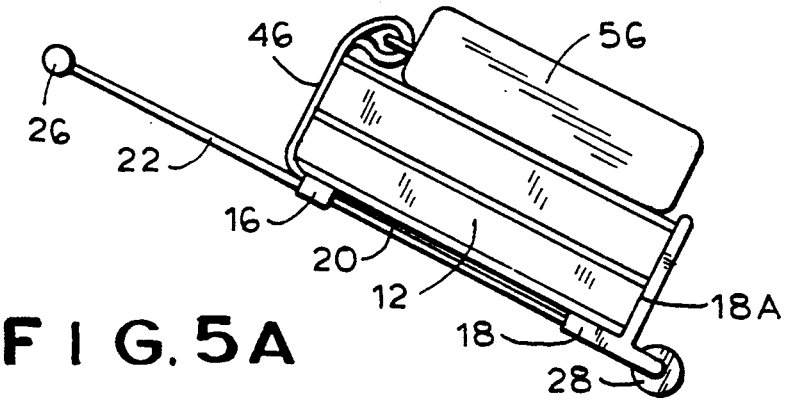
FIG. 5A

WHEELED SUITCASE OF LUGGAGE SUPPORT WITH COLLAPSIBLE TOWING HANDLE

BACKGROUND OF THE INVENTION

The present invention relates to a wheeled suitcase or suitcase support having a collapsible towing handle.

There is a need for improved wheeled suitcases or suitcase supports having collapsible towing handles. U.S. Pat. No. 4,995,487 discloses a wheeled suitcase and luggage support. U.S. Pat. Nos. 4,618,035, 4,261,447, 3,917;038, 2,581,417, 4,759,431, 3,257,120, 3,606,372, 4,087,102, 4,256,320, 4,411,343, 4,616,379, 4,792,025, and DE 3,328,063, FR 2,409,720, FR 2,538,229, GB 1,539,021 and GB 2,168,035 are exemplary of the prior art in the field of wheeled suitcases, towing handles for suitcases and supporting structures for moving luggage.

Although the prior art shows various forms of wheeled luggage, supports therefor and towing handles for luggage, there is a need for an improved wheeled suitcase which is convenient to use, economical, does not interfere with use of the luggage or invade into the carrying space of the luggage, and which provides versatile modes of use.

SUMMARY OF THE INVENTION

It is an object of the present invention to provide an improved wheeled suitcase or luggage support.

It is yet still a further object of the present invention to provide an improved wheeled suitcase or luggage support which has a collapsible towing handle.

It is yet still an additional object of the present invention to provide a wheeled suitcase or luggage support having a towing handle which mounts externally of the suitcase proper, thereby not interfering with use of the interior space of the suitcase.

It is yet still a further object of the present invention to provide a wheeled suitcase or luggage support having a collapsible towing handle which allows the towing handle to be securely held in its extended and collapsed positions.

It is yet still an additional object of the present invention to provide a wheeled suitcase or luggage support having a collapsible towing handle wherein the mechanism for the collapsible towing handle is disposed outside the suitcase but partially concealed from view by additional luggage compartments.

It is yet still a further object of the present invention to provide a wheeled suitcase or luggage support having a collapsible towing handle which can be carried on board aircraft as "carry-on" luggage, both of U.S. and foreign carriers.

It is yet still a further object of the present invention to provide a wheeled suitcase or luggage support having a collapsible towing handle which is suitable for use in a variety of modes, including towing via the collapsible towing handle, towing via a separate fixed handle provided on the suitcase support, or which can be carried much like a regular suitcase.

It is yet still a further object of the present invention to provide a wheeled suitcase or luggage support which allows the "piggy-backing" of additional luggage.

The above and other objects of the present invention are achieved by a suitcase comprising a luggage member, a support structure attached to the luggage member, the support structure comprising a first horizontal member having two wheels thereon to facilitate towing on the ground, a second horizontal member, two tubular members coupling the first and second horizontal members, thereby forming a rectangular frame, a shaft in extensible slidable engagement in each of said tubular members, the shafts being connected by a first handle, the shafts being extensible between a collapsed position in the tubular members and a fully extended position to enable towing of the luggage member on the wheels, at least one of the shafts including a wedging member slidable within the respective tubular member which is received frictionally in a first bore provided at an end of the respective tubular member adjacent the second horizontal member to maintain the shafts in the fully extended position.

The above and other objects of the invention are also achieved by a luggage support comprising a support structure, the support structure comprising a first horizontal member having a planar luggage support surface and having two wheels thereon to facilitate towing on the ground, a second horizontal member, two tubular members coupling the first and second horizontal members, thereby forming a rectangular frame, a shaft in extensible slidable engagement in each of said tubular members, the shafts being connected by a first handle, the shafts being extensible between a collapsed position in the tubular members and a fully extended position to enable towing of the luggage member on the wheels, at least one of the shafts including a wedging member slidable within the respective tubular member which is received frictionally in a first bore provided at an end of the respective tubular member adjacent the second horizontal member to maintain the shafts in the fully extended position.

Other features and advantages of the present invention will become apparent from the following description of the invention which refers to the accompanying drawings.

BRIEF DESCRIPTION OF THE DRAWINGS

The invention will now be described in greater detailed in the following detailed description with reference to the drawings in which:

FIG. 5 shows a further feature of the present invention allowing an additional suitcase to be piggy-backed to the suitcase according to the present invention.

FIG. 5A shows a piggy-backed suitcase as carried by the suitcase or luggage support according to the invention.

DETAILED DESCRIPTION OF THE INVENTION

Figure 1:
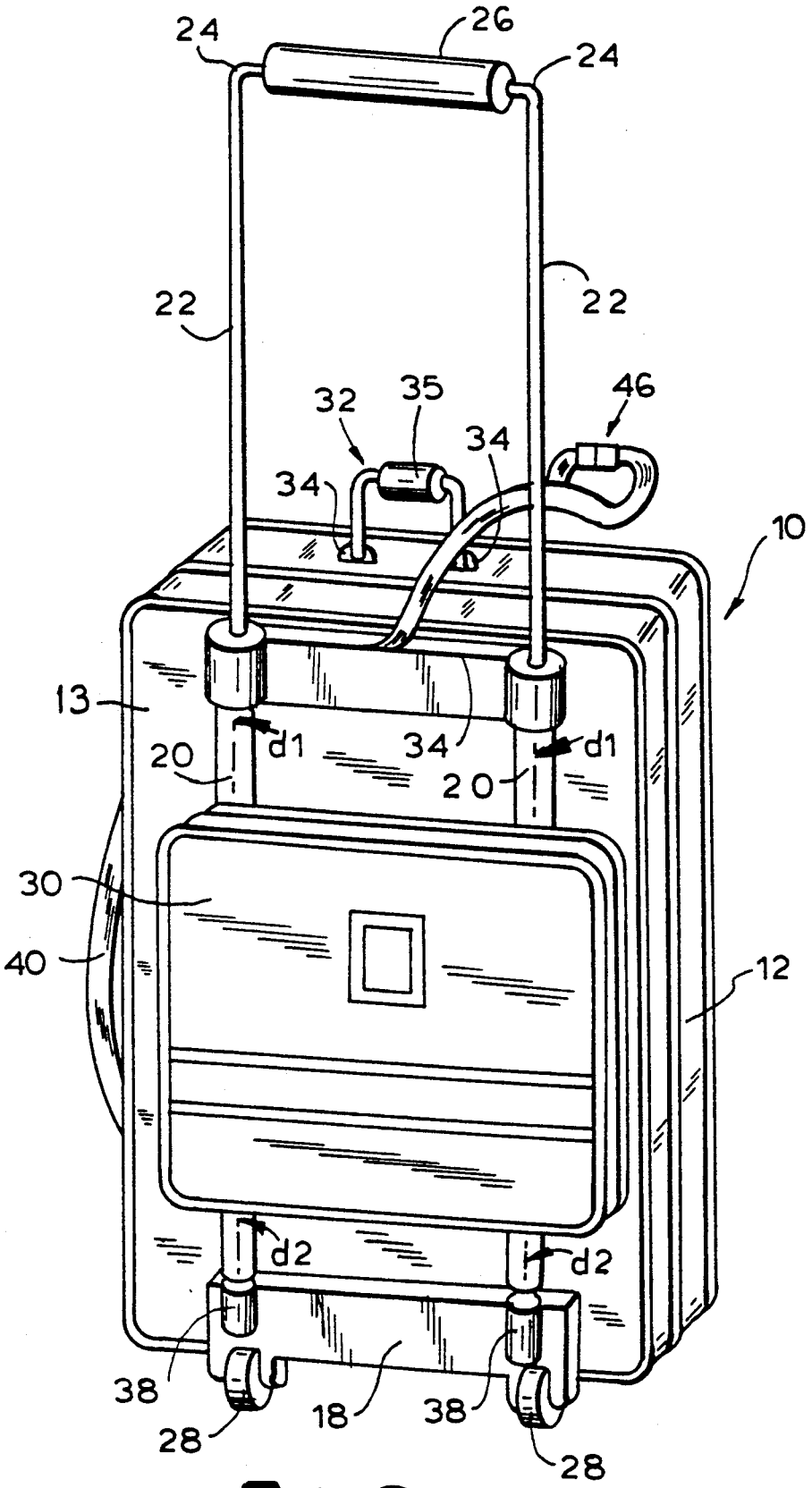
FIG. 1 is a perspective view of the suitcase according to the present invention.
Figure 6:
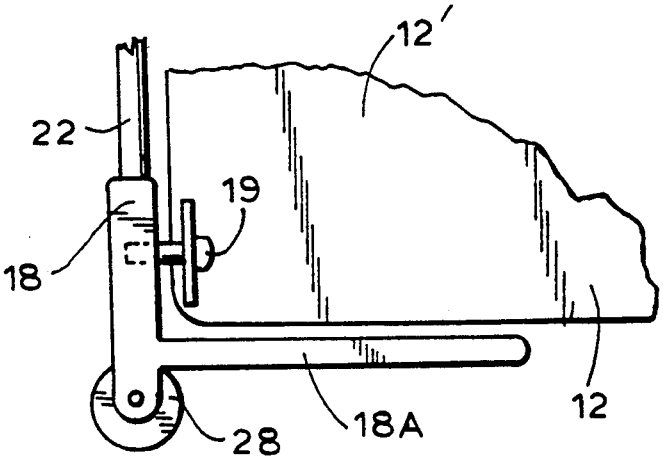
FIG. 6 shows details of the support structure, partly in cross section.

With reference now to the drawings, FIG. 1 shows a suitcase according to the present invention, generally designated as 10. The suitcase includes a luggage element 12, which can be either a rigid or a soft style suitcase, as known in the art. As shown in FIG. 1, the luggage element is substantially rectangularly shaped defining an inner luggage space 12' (FIG. 6).

Attached to the outside wall 13 of the suitcase 12 is a structure 14 comprising a top horizontal member 16, a bottom member 18, and two vertical guides 20. The two guides are tubular in nature. Extending within the two guides 20 are two shafts 22, which may be made from a single integral rod, suitably bent at 24, and having a padded handle 26 connecting the shafts 22 or covering the integral rod. The rods 22 extend into and are slidably disposed in the tubes 20. The tubes 20 are sufficiently long to allow the shafts 22 to extend in the retracted position, substantially completely within the tubes 20, leaving only the upper portions of the shafts 22 at the handle 26 exposed.

The bottom horizontal member 18 includes two wheels 28, for allowing the suitcase to move along the ground, towed by a person, after extending the shafts 22 from the tubes 20. The suitcase 12 may be suitably attached to the structure 14, for example, by attaching the suitcase with suitable fasteners such as screws or rivets 19, to the members 16 and 18. This is shown in FIG. 6. Preferably, member 18 includes a planar extending portion 18A to provide bottom support for suitcase 12. Alternatively, suitcase 12 may not be permanently attached to the supporting structure. In this case, the supporting structure is akin to a dolly, and the suitcase 12 is removably attached to the supporting structure with suitable straps or elastic cords, as known to those of skill in the art.

A second smaller luggage compartment 30 may be attached to the structure 14 as shown in FIG. 1, thereby substantially concealing the structure 14 as well as providing additional luggage space.

The suitcase 12 preferably includes a handle 32, which is hinged substantially as shown at 34, and a suitable padding material, for example, either a hard or soft padding 35, can be provided. The handle 32 might comprise, for example, a hard plastic. The handle 32 can be used to facilitate carrying of the suitcase or towing. The handle 32 could also optimally be provided at the top of member 16 to facilitate towing using this handle.

Figure 2:
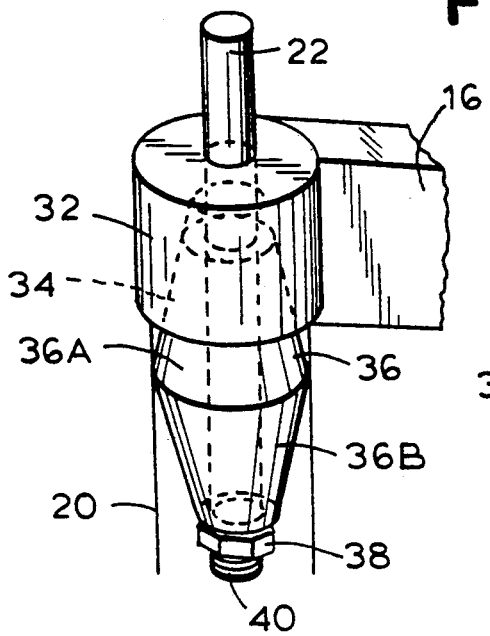
FIG. 2 is a detailed view, partially in phantom, showing a portion of the device according to the present invention.

FIG. 2 shows details of the structure 14. The horizontal member 16 includes a tubular bushing end 32. As shown in the embodiment of FIG. 2, the tubular end 32 can include a tapered internal bore 34, which receives a frusto-conically shaped member 36, which is attached to shaft 22. Preferably, the frusto-conical member 36 is a dual frusto-conical member comprising back-to-back frusto-conical elements 36A and 36B, as shown in FIG. 2, and suitably attached to the shaft 22, as for example, by a nut 38 engaging threads 40 of the shaft 22. Although two elements 36 preferably are used, one in each guide 20, only one need be employed. Also, member 36 is shown as two back-to-back elements 36A and 36B. Only element 36A can be provided so that the shafts 22 are maintained only in their fully extended position, although preferably, both elements 36A and 36B are provided, as explained more fully below.

The purpose of the frusto-conical member 36, which is preferably made of a soft material, for example, rubber or plastic or some other material which has a degree of resiliency, is to provide a wedging action so that when the shafts 22 are extended from the tubes 20, the frusto-conical member 36A frictionally engages with the conically shaped bore 34, i.e., it becomes wedged in the conically shaped bore 34, thereby maintaining the shafts 22 in the retracted position. This is important, because it prevents the shafts 22 from sliding loosely or collapsing suddenly when in use, thereby preventing injury.

The other portion 36B of the member 36 is provided so that when in the collapsed state, the shafts 22 remain in the tubes 20. A bore similar to bore 34 may also be provided in the member 18, as shown generally at 38 in FIG. 1, for receiving the frusto-conical shaped element 36B, thereby maintaining the shafts 22 in the collapsed position. This is important because it will prevent the shafts 22 from suddenly extending, for example, when the suitcase is lifted to place it into an airplane luggage rack.

Figure 3:
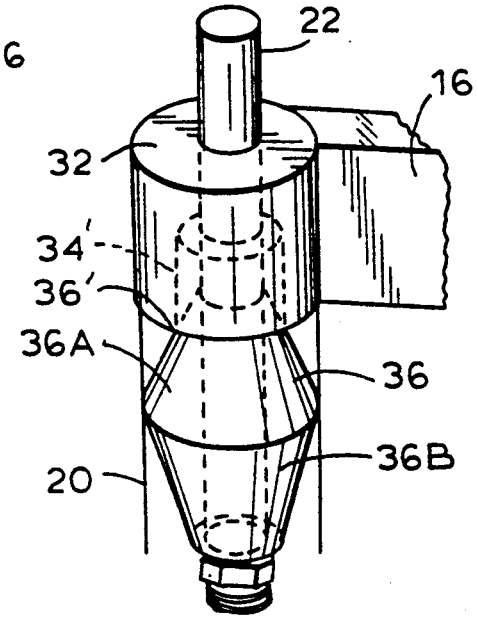
FIG. 3 is a detailed view, partially in phantom, showing an alternative embodiment of the portion of the device shown in FIG. 2.

FIG. 3 shows an alternative embodiment. In this embodiment, a cylindrical bore 34' is provided in the tubular bushing portion 32. The member 36 is held in the bore 34' at the lip 36 by the wedging action of the resilient element 36A into the bore 34'. Similarly, a bore similar to bore 34' can be provided in the horizontal member 18 at 38, shown generally in FIG. 1.

Figure 4:
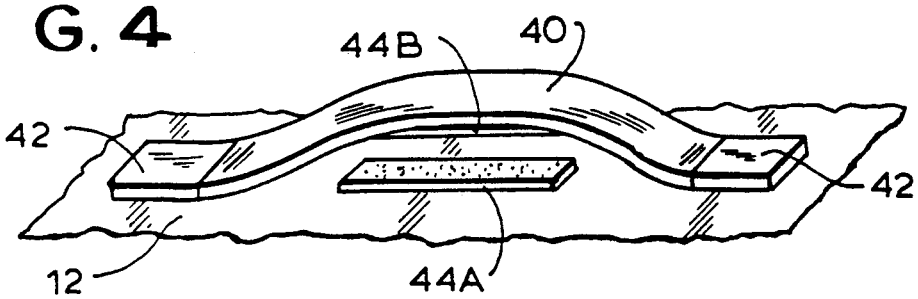
FIG. 4 is a detailed view showing one of the handles of the suitcase according to the present invention.

FIG. 4 shows the collapsible handle 40 which is provided on a side of the suitcase 12. The collapsible handle may be made of a soft material for comfort, and is suitably attached to the suitcase 12 at 42, as known to those of skill in the art. Preferably, a mating hook and loop type fastener 44A and 44B is provided to allows the handle 40 to remain flat against the suitcase 12. Preferably, 44A is the hook portion of the hook and loop fastener and 44B is the softer loop portion, for comfort. A suitable hook and loop fastener might be, for example, the material sold under the trademark VELCRO. To provide even more versatility, a handle 40 can also be provided on the other side of the suitcase 12 opposite the side where the handle 40 is shown in FIG. 1.

FIG. 5 shows an additional feature of the invention shown also in FIG. 1. Attached to the structure 14 is an additional strap 46, which allows another suitcase to be piggy-backed alongside and on top of the suitcase 12. The strap 46 preferably is fastened to the element 16 by suitable fasteners as shown at 48. The strap generally is shaped as a loop and includes a detachable snap fastener 50, 52, as shown in FIG. 5. Preferably, the strap is made of a strong material such as nylon. When the detachable snap fasteners 50, 52, preferably made of a molded plastic material, as known to those of skill in the art, are detached, the handle 54 of another suitcase 56 is inserted in the loop of the strap 46, and the snap fasteners 50, 52 are redone, thereby securely holding the additional suitcase 56 to the suitcase 12. As shown, the strap 46 may include two sections 46A and 46B suitably sewn together at 58. The piggy-backed suitcase 56 attached to the support is shown in FIG. 5A in a side view, as it might actually be towed.

Another feature of the invention will now be described which can facilitate the maintenance of the shafts 22 at any amount of extension. The embodiments shown in FIGS. 2 and 3 allow the shafts 22 to be maintained fixedly in the collapsed and fully extended positions without the shafts 22 suddenly extending or collapsing. At the same time, the resiliency of the members 36 allows the shafts 22 to be extended or collapsed with a small amount of force applied by the user.

An additional feature, which allows the shafts to be extended by any amount between the fully collapsed and fully extended position, and to maintain that degree of extension, is the construction of the assembly 14 so that the distances d1 and d2, i.e., the distances between the centers of the tubes 20, are unequal. These distances d1 and d2 are shown in FIG. 1. This will apply a frictional force against the members 36, thereby holding them securely in the tubes 20 at any position. Although the amount of friction may not be enough to tow the suitcase 12 with the handle at any position between the fully collapsed and fully extended position, it will be sufficient to prevent the handle from falling freely or extending freely when between the fully extended or fully collapsed position. This is useful in preventing sudden movements of the shafts 22 when the members 36 are not seated in the bores 34 or 34'. A suitable difference between the dimensions d1 and d2 might be, for example, ¼ to ½ inch. The dimensions d1 and d2 are shown in FIG. 1.

The present invention thus provides a convenient, easy to use, towable suitcase or luggage support which can be used versatilely in a variety of modes. The suitcase can be towed on the wheels 28 via the handle 26, or it can be carried or towed via the handle 32 or carried via the handle 40. Additionally, the provision of the assembly 14 on the outside of the suitcase means there is additional room within the luggage compartment of the suitcase 12. The structure 14 can also be hidden substantially from view by the provision of an additional luggage member 30, as shown, for example, in FIG. 1.

Preferably, suitcase 12 is provided of a size such that it can be carried onto aircraft as "carry-on" luggage. Thus, preferably, the suitcase is less than approximately 21" or 22" in width (the horizontal extent of the suitcase shown in FIG. 1), or as required by applicable governmental or carrier regulations.

Preferably, the strap 46 is made adjustable, as known to those of skill in the art, so that it can accommodate suitcases of different size. The adjustability is provided by a suitable locking member receiving a loop of the strap 46A, as shown at 60.

The padding 36 on the handle 32 can be either a soft padding or the entire handle or padding 36 can be made of a hard plastic material, to facilitate towing. The handle 40, because it will be used to lift the suitcase, preferably should be made of a soft material, for example, leather or other suitable material, synthetic or natural. It is preferably flattenable, as described, so as not to interfere with stowage.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A suitcase comprising:

a luggage member, a support structure attached to the luggage member, the support structure comprising a first horizontal member having two wheels thereon to facilitate towing on the ground, a second horizontal member, two tubular members coupling the first and second horizontal members, thereby forming a rectangular frame, a shaft in extensible slidable engagement in each of said tubular members, the shafts being connected by a first handle, the shafts being extensible between a collapsed position in the tubular members and a fully extended position to enable towing of the luggage member on the wheels, at least one of the shafts including a wedging member slidable within the respective tubular member which is received frictionally in a first bore provided at an end of the respective tubular member adjacent the second horizontal member to maintain the shafts in the fully extended position.

2. The suitcase recited in claim 1, further wherein the wedging member is double ended and a second bore is provided near the other end of a respective tubular member so that the wedging member is frictionally receivable in the second bore to maintain the shafts in the collapsed position.

3. The suitcase recited in claim 2, further comprising a first and second bore near respective ends of both of said tubular members and double ended wedging members provided on both of said shafts.

4. The suitcase recited in claim 1, wherein the wedging member is frusto-conical in shape and the first bore is conical in shape to receive the wedging member.

5. The suitcase recited in claim 1, wherein the wedging member is frusto-conical in shape and the first bore is substantially cylindrical, with the wedging member defining a point of frictional engagement with a lip of the first bore.

6. The suitcase recited in claim 3, wherein the wedging member is double ended so that it has two opposed frusto-conical members, each being received in a respective one of the first and second bores.

7. The suitcase recited in claim 1, wherein the tubular members are disposed in non-parallel relationship to provide frictional engagement between the interior of the tubular member and the wedging member.

8. The suitcase recited in claim 1, wherein the support structure is disposed outside the luggage member.

9. The suitcase recited in claim 1, further comprising a second handle disposed on the luggage member for facilitating carrying of the suitcase or towing the luggage member.

10. The suitcase recited in claim 1, further comprising an additional handle disposed on the luggage member for facilitating carrying of the suitcase.

11. The suitcase recited in claim 10, further wherein the additional handle is flattenable.

12. The suitcase recited in claim 11, further comprising a fastener disposed beneath the additional handle for maintaining the additional handle in a substantially flattened condition.

13. The suitcase recited in claim 12, wherein the fastener is a hook and loop fastener, with the hook portion disposed on the luggage member and the loop portion disposed on an underside of the additional handle.

14. The suitcase recited in claim 1, further comprising a strap attached to said second horizontal member for receiving the handle of a second suitcase to enable piggy-back carrying of the second suitcase.

15. The suitcase recited in claim 14, further comprising a snap fastener provided in said strap for facilitating attaching and removal of the second suitcase.

16. The suitcase recited in claim 15, wherein the strap is adjustable.

17. A luggage support comprising:

a support structure, the support structure comprising a first horizontal member having a planar luggage support surface and having two wheels thereon to facilitate towing on the ground, a second horizontal member, two tubular members coupling the first and second horizontal members, thereby forming a rectangular frame, a shaft in extensible slidable engagement in each of said tubular members, the shafts being connected by a first handle, the shafts being extensible between a collapsed position in the tubular members and a fully extended position to enable towing of the luggage member on the wheels, at least one of the shafts including a wedging member slidable within the respective tubular member which is received frictionally in a first bore provided at an end of the respective tubular member adjacent the second horizontal member to maintain the shafts in the fully extended position.

18. The luggage support recited in claim 17, further wherein the wedging member is double ended and a second bore is provided near the other end of a respective tubular member so that the wedging member is frictionally receivable in the second bore to maintain the shafts in the collapsed position.

19. The luggage support recited in claim 18, further comprising a first and second bore near respective ends of both of said tubular members and double ended wedging members provided on both of said shafts.

20. The luggage support in claim 17, wherein the wedging member is frusto-conical in shape and the first bore is conical in shape to receive the wedging member.

21. The luggage support recited in claim 17, wherein the wedging member is frusto-conical in shape and the first bore is substantially cylindrical, with the wedging member defining a point of frictional engagement with a lip of the first bore.

22. The luggage support recited in claim 19, wherein the wedging member is double ended so that it has two opposed frusto-conical members, each being received in a respective one of the first and second bores.

23. The luggage support recited in claim 17, wherein the tubular members are disposed in non-parallel relationship to provide frictional engagement between the interior of the tubular member and the wedging member.

24. The luggage support recited in claim 17, further comprising a second handle disposed on the second horizontal member.

25. A suitcase comprising:

a luggage member substantially rectangular in shape and defining an inner luggage space and having an outside wall;

a support structure attached to the outside wall of the luggage member, the support structure comprising a first horizontal member having two wheels thereon to facilitate towing on the ground, a second horizontal member, two tubular members coupling the first and second horizontal members, thereby forming a rectangular frame, a shaft in extensible slidable engagement in each of said tubular members, the shafts being connected by a first handle, the shafts being extensible between a collapsed position and the tubular members in a fully extended position to enable towing of the luggage member on the wheel; and a second smaller luggage member defining a second luggage compartment, the second smaller luggage member being located on the outside wall of the luggage member, the tubular members penetrating into the second luggage compartment and being substantially concealed therein.

26. The suitcase recited in claim 25, wherein at least one of the shafts includes a wedging member slidable within the respective tubular member which is received fictionally in a first bore provided at an end of the respective tubular member adjacent the second horizontal member to maintain the shafts in the fully extended position.

27. The suitcase recited in claim 26, wherein the wedging member is double ended and a second bore is provided near the other end of a respective tubular member so that the wedging member is fictionally receivable in the second bore to maintain the shafts in the collapsed position.

28. The suitcase recited in claim 26, wherein the tubular members are disposed in non-parallel relationship to provide frictional engagement between the interior of the tubular member and the wedging member.

* * * * *